US008899299B2

(12) United States Patent
Stewart

(10) Patent No.: US 8,899,299 B2
(45) Date of Patent: Dec. 2, 2014

(54) LEADING END ASSEMBLIES FOR MOVABLE PARTITIONS INCLUDING DIAGONAL MEMBERS, MOVABLE PARTITIONS INCLUDING LEADING END ASSEMBLIES AND RELATED METHODS

(75) Inventor: Ivan W. Stewart, Herriman, UT (US)

(73) Assignee: Won-Door Corporation, Salt Lake City, UT (US)

( * ) Notice: Subject to any disclaimer, the term of this patent is extended or adjusted under 35 U.S.C. 154(b) by 410 days.

(21) Appl. No.: 13/234,439

(22) Filed: Sep. 16, 2011

(65) Prior Publication Data

US 2013/0067818 A1 Mar. 21, 2013

(51) Int. Cl.

| | |
|---|---|
| ***E05F 11/00*** | (2006.01) |
| ***E05F 15/00*** | (2006.01) |
| ***E05F 5/02*** | (2006.01) |

(52) U.S. Cl.

CPC ..... *E05F 5/025* (2013.01); *E05Y 2800/122* (2013.01); *E05F 15/0082* (2013.01); *E05Y 2900/142* (2013.01); *E05Y 2600/322* (2013.01)

USPC ..... 160/188; 160/199

(58) Field of Classification Search

CPC ..... E06B 3/4654; E06B 3/48; E06B 3/94; E05F 15/0082; E05F 15/145; E05F 15/103; E05F 15/0004; E05F 15/0017; E05F 15/0021

USPC ..... 160/1, 196.1, 188, 199, 201, 84.02, 160/84.08; 49/25–27; 104/89, 130.01; 105/163.2

See application file for complete search history.

(56) References Cited

U.S. PATENT DOCUMENTS

| | | | | |
|---|---|---|---|---|
| 2,027,992 A | | 1/1936 | Maurer | |
| 2,573,160 A | * | 10/1951 | August | 49/379 |
| 3,223,147 A | | 12/1965 | Holloway | |
| 3,577,679 A | | 5/1971 | Petterborg | |

(Continued)

FOREIGN PATENT DOCUMENTS

| | | |
|---|---|---|
| EP | 1471028 | 10/2004 |
| EP | 1518814 | 3/2005 |

(Continued)

OTHER PUBLICATIONS

Goodman et al., U.S. Appl. No. 13/165,165, filed Jun. 21, 2011 entitled "Leading End Assemblies for Movable Partitions Including Sensor Assemblies, Movable Partition Systems Including Sensor Assemblies and Related Methods.".

*Primary Examiner* — Katherine Mitchell
*Assistant Examiner* — Abe Massad
(74) *Attorney, Agent, or Firm* — TraskBritt

(57) ABSTRACT

Leading end assemblies for movable partitions may include a movable trolley, a leading structure coupled to the movable trolley, a diagonal member comprising at least one movable feature enabling the leading structure to move from an initial position to a displaced position, and at least one sensor for sensing movement of the leading structure. Movable partition systems may include a leading structure suspended from a trolley and a sensor configured to sense rotation of the leading structure relative to the trolley. Methods of operating a movable partition may include moving at least a portion of a movable partition along a path from a retracted position to an extended position, rotating a leading structure of the movable partition about a coupling, using a sensor to sense rotation of the leading structure, and ceasing movement of the movable partition in response to a signal generated by the sensor.

13 Claims, 6 Drawing Sheets

(56) References Cited

U.S. PATENT DOCUMENTS

| | | | | |
|---|---|---|---|---|
| 3,720,254 | A | 3/1973 | Smart | |
| 3,773,145 | A | 11/1973 | Drexler | |
| 3,955,661 | A | 5/1976 | Popper et al. | |
| 4,042,066 | A | 8/1977 | Noone | |
| 4,133,364 | A | 1/1979 | Smart | |
| 4,300,663 | A | 11/1981 | Hmelovsky et al. | |
| 4,422,029 | A | 12/1983 | Demers et al. | |
| 4,693,340 | A * | 9/1987 | Shanks et al. | 187/317 |
| 4,724,884 | A * | 2/1988 | Weem | 160/84.08 |
| 4,794,248 | A | 12/1988 | Gray | |
| 4,834,161 | A | 5/1989 | Johnson et al. | |
| 4,924,929 | A | 5/1990 | Johnson et al. | |
| 4,976,337 | A | 12/1990 | Trett | |
| RE33,668 | E | 8/1991 | Gray | |
| 5,131,506 | A | 7/1992 | Mizuno et al. | |
| 5,162,711 | A | 11/1992 | Heckler | |
| RE34,665 | E | 7/1994 | Strand | |
| 5,625,266 | A | 4/1997 | Stark | |
| 5,636,714 | A | 6/1997 | Viola | |
| 6,167,991 | B1 | 1/2001 | Full et al. | |
| 6,626,268 | B1 | 9/2003 | Masuda et al. | |
| 6,662,848 | B2 | 12/2003 | Goodman et al. | |
| 6,883,515 | B2 * | 4/2005 | Kuttalek | 126/190 |
| 7,093,692 | B2 | 8/2006 | Koura | |
| 7,211,975 | B2 | 5/2007 | Murray et al. | |
| 7,237,655 | B2 | 7/2007 | Kocher | |
| 7,342,370 | B2 | 3/2008 | Greene et al. | |
| 7,478,663 | B2 | 1/2009 | Goodman et al. | |
| 7,503,205 | B2 | 3/2009 | Baillargeon et al. | |
| 7,503,594 | B2 | 3/2009 | Peacock et al. | |
| 7,513,293 | B2 | 4/2009 | Goodman et al. | |
| 7,845,386 | B2 | 12/2010 | Coleman et al. | |
| 8,544,524 | B2 * | 10/2013 | Goodman et al. | 160/199 |
| 2001/0045327 | A1 | 11/2001 | Shemanske, II et al. | |
| 2004/0159500 | A1 | 8/2004 | Koura | |
| 2004/0173415 | A1 | 9/2004 | Kocher | |
| 2005/0131606 | A1 | 6/2005 | Motozawa et al. | |
| 2006/0144643 | A1 | 7/2006 | Koura | |
| 2007/0095488 | A1 | 5/2007 | Huang | |
| 2008/0169069 | A1 * | 7/2008 | Coleman et al. | 160/199 |
| 2008/0184623 | A1 | 8/2008 | Heigl et al. | |
| 2008/0264578 | A1 * | 10/2008 | Goodman et al. | 160/202 |
| 2009/0120595 | A1 * | 5/2009 | Goodman et al. | 160/371 |
| 2010/0056311 | A1 * | 3/2010 | Kondash et al. | 474/136 |
| 2011/0000625 | A1 | 1/2011 | George | |
| 2011/0005689 | A1 | 1/2011 | Coleman et al. | |
| 2011/0093095 | A1 * | 4/2011 | Goodman et al. | 700/13 |
| 2011/0186249 | A1 * | 8/2011 | Coleman et al. | 160/405 |
| 2012/0012259 | A1 * | 1/2012 | Goodman | 160/127 |
| 2012/0325413 | A1 * | 12/2012 | Smart et al. | 160/84.02 |

FOREIGN PATENT DOCUMENTS

| | | |
|---|---|---|
| WO | WO8101837 | 7/1981 |
| WO | WO8202787 | 8/1982 |
| WO | WO8809862 | 12/1988 |
| WO | WO0142120 | 6/2001 |
| WO | WO2004096690 | 11/2004 |

* cited by examiner

LEADING END ASSEMBLIES FOR MOVABLE PARTITIONS INCLUDING DIAGONAL MEMBERS, MOVABLE PARTITIONS INCLUDING LEADING END ASSEMBLIES AND RELATED METHODS

TECHNICAL FIELD

Embodiments of the present disclosure relate to diagonal members for movable partitions and related systems and methods. In particular, embodiments of the disclosure relate to diagonal members coupled to leading end assemblies of movable partitions where the diagonal members enable deflection of a portion of the leading end assemblies.

BACKGROUND

Movable partitions are utilized in numerous situations and environments for a variety of purposes. Such partitions may include, for example, a movable partition comprising foldable or collapsible panels configured to enclose or subdivide a room or other area. Often such partitions may be utilized simply for purposes of versatility in being able to subdivide a single large room into multiple smaller rooms. The subdivision of a larger area may be desired, for example, to accommodate multiple groups or meetings simultaneously. In other applications, such partitions may be utilized for noise control depending, for example, on the activities taking place in a given room or portion thereof Movable partitions may also be used to provide a security barrier, a fire barrier, or both a security barrier and a fire barrier. For example, when implemented as a fire barrier, movable partitions may be constructed to meet certain specifications relating to fire resistance and may be utilized as fire barrier doors in condominiums, apartments, office buildings, high-rise buildings, casinos, malls, or any other location where desired or required by fire codes. The movable partitions are normally open and, when a fire is sensed, are automatically closed. In such a case, the partition barrier may be configured to automatically close upon the occurrence of a predetermined event such as the actuation of an associated alarm. For example, one or more accordion or similar folding-type partitions may be used as a security barrier, a fire barrier, or both a security barrier and a fire barrier wherein each partition is formed with a plurality of panels connected to one another with hinges. The hinged connection of the panels allows the partition to fold and collapse into a compact unit for purposes of storage when not deployed. The partition may be stored in a pocket formed in the wall of a building when in a retracted or folded state. When the partition is deployed to subdivide a single large room into multiple smaller rooms, secure an area during a fire, or for any other reason, the partition may be extended along an overhead track, which is often located above the movable partition in a header assembly, until the partition extends a desired distance across the room.

When deployed, a leading end of the movable partition, often defined by a component known as a lead post, complementarily engages a receptacle in a fixed structure, such as a wall, or engages a mating receptacle of another door. Such a receptacle may be referred to as a striker, door jamb or a door post when formed in a fixed structure, or as a mating lead post when formed in another movable partition. It is desirable that the lead post be substantially aligned with the mating receptacle such that the movable partition may be completely closed and an appropriate seal formed between the movable partition and the mating receptacle.

When implemented as an automatic door system including, for example, a motor and a control system, the movable partition often includes various sensors and switches to assist in the control of the movable partition. For example, a conventional automatic movable partition, when used as a fire barrier, may include a button that a user may press to cease movement of the door or may include a control system that can sense a load applied to the motor driving the movable partition resulting from an obstruction blocking the path of the movable partition while the movable partition is closing.

BRIEF SUMMARY

In some embodiments, the present disclosure includes a leading end assembly for a movable partition. The leading end assembly includes a trolley for moving the leading end assembly along a track of a movable partition, a leading structure coupled to the trolley, and a diagonal member extending from the trolley at an oblique angle to the track. The diagonal member comprises at least one movable feature enabling the leading structure to displace from an initial position to a displaced position. At least one sensor is configured to sense movement of the leading structure between the initial position and the displaced position.

In additional embodiments, the present disclosure includes a movable partition system comprising a plurality of hingedly coupled panels movably coupled to a track and a leading end assembly coupled to at least one panel of the plurality of hingedly coupled panels. The leading end assembly includes a trolley movably coupled to the track and a leading structure suspended from and coupled to the trolley where at least one coupling between the leading structure and the trolley enables the leading structure to rotate relative to the trolley. The leading end assembly also includes a sensor configured to sense rotation of the leading structure relative to the trolley.

In yet additional embodiments, the present disclosure includes a method of operating a movable partition. The method includes moving at least a portion of a movable partition along a path from a retracted position to an extended position with a motor, rotating a leading structure of the movable partition about a coupling to displace at least a portion of the leading structure from an initial position to a displaced position, using a sensor to sense rotation of the leading structure, and ceasing movement of the movable partition in response to a signal generated by the sensor.

BRIEF DESCRIPTION OF THE DRAWINGS

While the specification concludes with claims particularly pointing out and distinctly claiming what are regarded as embodiments of the present disclosure, the advantages of embodiments of the disclosure may be more readily ascertained from the description of example embodiments of the disclosure set forth below when read in conjunction with the accompanying drawings, in which:

DETAILED DESCRIPTION

Illustrations presented herein are not meant to be actual views of any particular device, assembly, system, or method, but are merely idealized representations which are employed to describe embodiments of the present disclosure. Additionally, elements common between figures may retain the same numerical designation.

Figure 1:
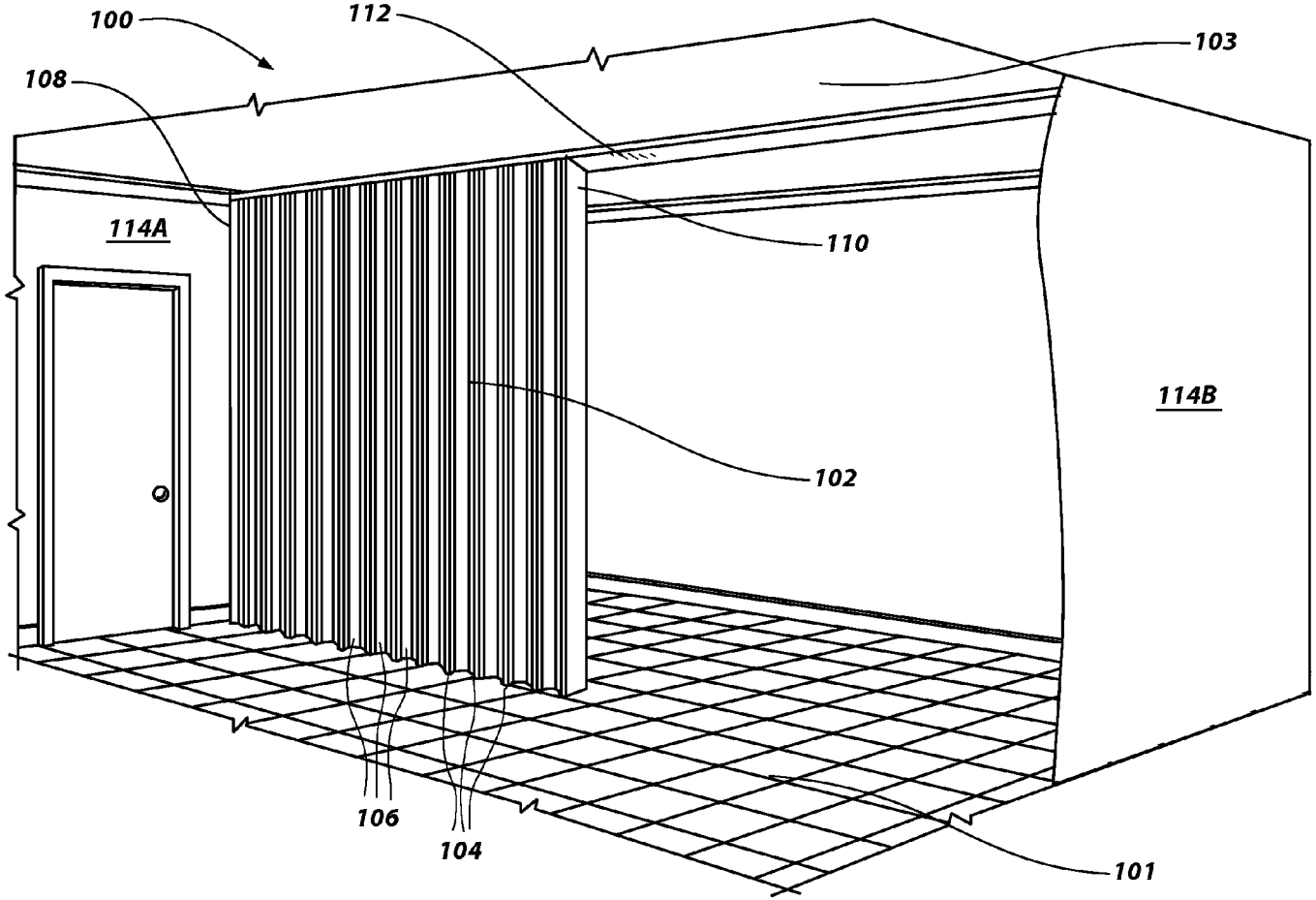
FIG. 1 is a perspective view of an embodiment of a movable partition system including a leading end assembly in accordance with an embodiment of the present disclosure.

Referring to FIG. 1, a system 100 is shown, which may also be referred to as a movable partition system 100, including a movable partition 102 in the form of an accordion-type door. The movable partition 102 may be used as a barrier (e.g., a security barrier, a fire barrier, or both a security barrier and a fire barrier). In other embodiments, the movable partition 102 may be used, for example, to subdivide a relatively larger space into relatively smaller spaces (e.g., rooms or areas). The movable partition 102 may be controlled (e.g., automatically controlled) to move between an extended position to a retracted position by a control system and motor (not shown) that may be located proximate to the movable partition system 100, in a portion of the movable partition system 100, or in a location separate from the movable partition system 100. The movable partition 102 may be formed with a plurality of panels 106 that are connected to one another with hinges or other hinge-like members 104 to form a pleated (i.e., a plicated) structure. The movable partition 102 is engaged with a track (e.g., suspended from an overhead track 112) along which the movable partition 102 moves as the movable partition 102 is extended (i.e., closed) and retracted (i.e., opened). The hinged connection of the panels 106 allows the movable partition 102 to be compactly stored in a movable partition storage area such as, for example, a storage pocket 108 formed in a wall 114A of a building when in a retracted or folded state.

To deploy the movable partition 102 to an extended position, the movable partition 102 is moved along the overhead track 112 to an adjoining structure positioned at an end portion of the overhead track 112. A leading end of the movable partition 102 may include a leading end assembly 110 having one or more of the panels 106 coupled thereto. For example, an end of the panels 106 forming the movable partition 102 may be coupled to the leading end assembly 110. The panels 106 may be coupled to the leading end assembly 110 in any suitable manner including, but not limited to, using adhesives, tongue and groove joints, and fasteners (e.g., screws, bolts, rivets, etc.).

The leading end assembly 110 may be configured to engage with an adjoining structure such as, for example, an opposing wall 114B, a door jamb, or a leading end assembly of another movable partition (not shown). In some embodiments, the leading end assembly 110 may be similar to the leading end assemblies described in, for example, U.S. patent application Ser. No. 12/497,310, which was filed Jul. 2, 2009 and is entitled "Movable Partitions, Leading End Assemblies for Movable Partitions and Related Methods," which is assigned to the assignee hereof and the disclosure of which is incorporated herein in its entirety by this reference. For example, a portion of the leading end assembly 110 (e.g., a leading structure 122 (FIG. 2A)) may be sized to form a barrier at an open end of the pocket 108 (e.g., the end of the pocket 108 through which the movable partition 102 may be extended along the overhead track 112) when the movable partition 102 is in a retracted state. In some embodiments, the leading structure 122 (FIG. 2A) may form a barrier substantially covering the open end of the pocket 108. In some embodiments, a leading surface 124 (FIGS. 2B and 2C) of the leading end assembly 110 may be substantially flush with a portion of the pocket 108 (e.g., the walls forming the pocket 108) when the movable partition 102 is retracted in a storage position within the pocket 108.

In other embodiments, the leading end assembly 110 of the movable partition system 100 may comprise a lead post such as, for example, the lead posts described in U.S. Patent No. 7,845,386, issued Dec. 10, 2010 and is entitled "Movable Partitions, Components for Movable Partitions and Related Methods," which is assigned to the assignee hereof and the disclosure of which is incorporated herein in its entirety by this reference.

While the embodiment of the movable partition 102 shown and described with reference to FIG. 1 contains a single accordion-type door, additional embodiments of the present disclosure may include multiple doors. For example, a partition may include two doors (e.g., accordion-type doors) configured to extend across a space and join together to partition a space.

Figure 2A:
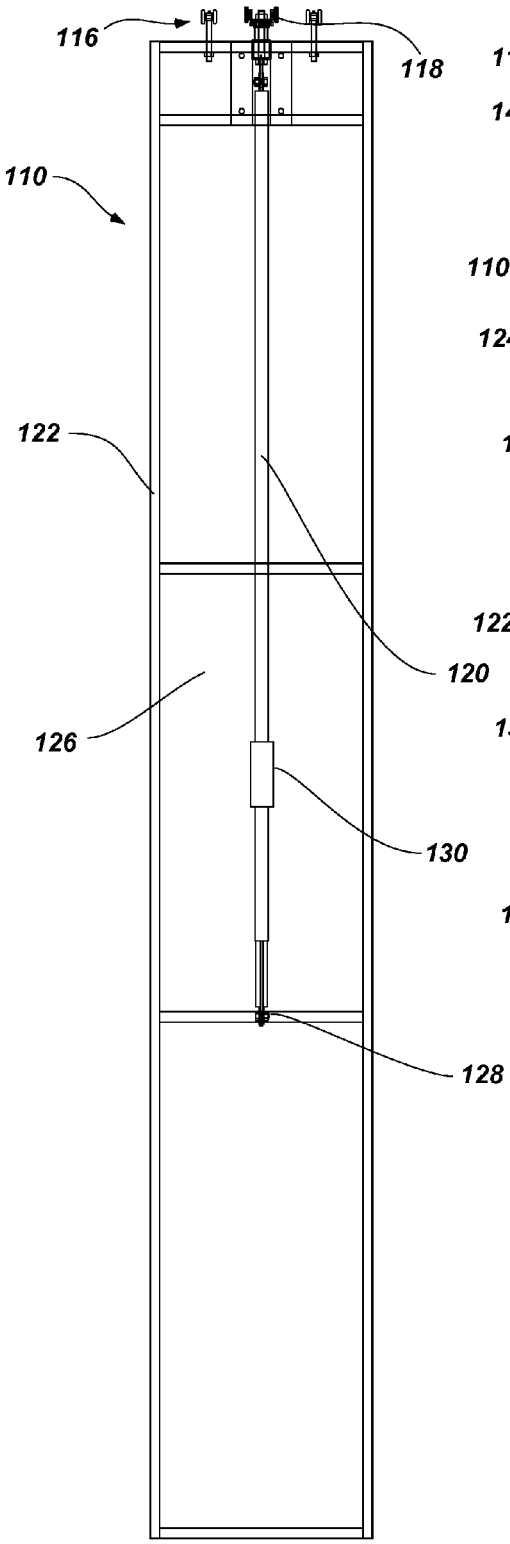
FIGS. 2A, 2B, and 2C are elevation views of a leading end assembly of a movable partition system including a diagonal member in accordance with an embodiment of the present disclosure.
Figure 2B:
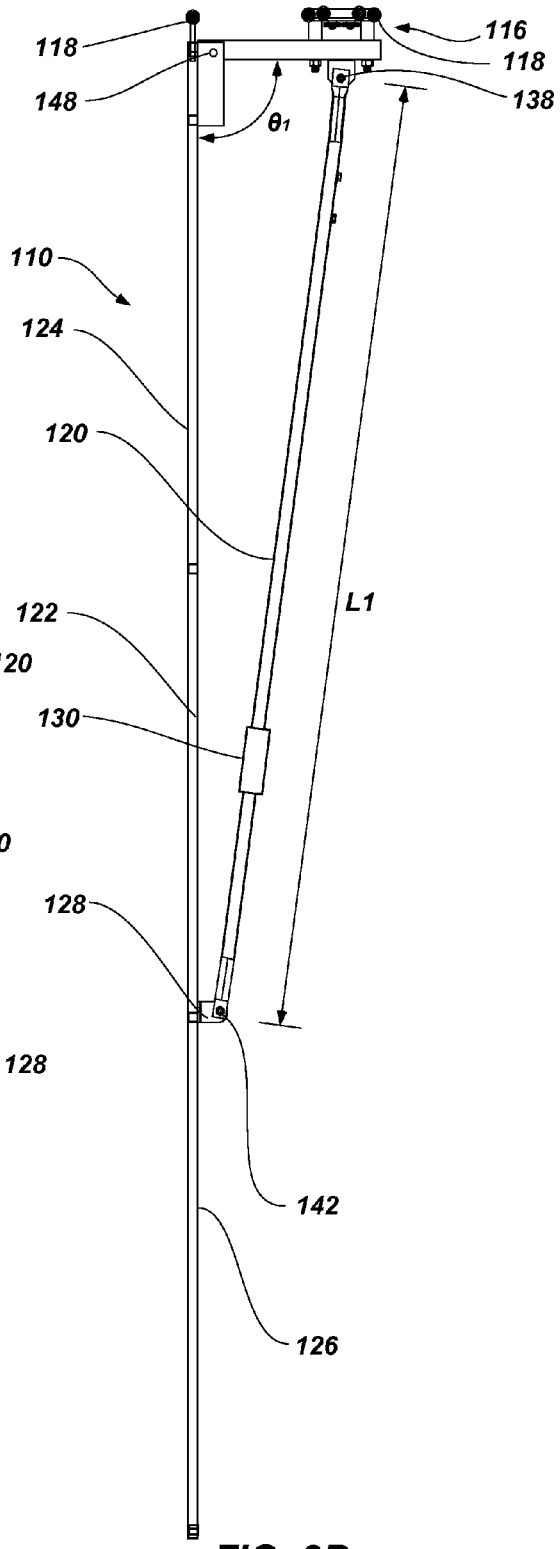

FIGS. 2A and 2B are elevation views (i.e., a trailing surface view as discussed below and a side view taken transverse to the trailing surface, respectively) of a leading end assembly for a movable partition system such as, for example, the movable partition system 100 shown and described with reference to FIG. 1. As shown in FIGS. 2A and 2B, the leading end assembly 110 may include a component for coupling (e.g., movably coupling) the leading end assembly 110 to an adjoining structure. In some embodiments, the leading end assembly 110 may include a component that suspends the leading end assembly 110 from the overhead track 112 (FIG. 1). For example, the leading end assembly 110 may be coupled to at least one support trolley 116 having trolley wheels 118 that are received in a portion (e.g., a channel) of the overhead track 112 to suspend the trolley 116 and leading end assembly 110 from the track 112. The trolley wheels 118 of the support trolley 116 may move along the track 112 by the rolling of the trolley wheels 118. The support trolley 116 may include a connection to a chain drive driven by a motor, or, in some embodiments, the support trolley 116 may include a motor, for example, an electric motor connected to a power source to displace the leading end assembly 110 along the overhead track 112.

The leading end assembly 110 may comprise a leading portion (e.g., a leading surface 124 of the leading structure 122) that may be positioned adjacent to (e.g., in abutment with) an adjoining structure such as, for example, an opposing wall 114B (FIG. 1) or the leading end assembly of another movable partition (not shown). As used herein, "leading surface" means a distal surface of the leading end assembly 110 (e.g., the surface of an element located furthest from the point of attachment with the panels 106 of the movable partition 102 (FIG. 1)). The leading end assembly 110 may further comprise a trailing portion such as, for example, a trailing surface 126 of the leading structure 122 positioned opposite to the leading surface 124. As used herein, "trailing surface" means a proximal surface of the leading end assembly 110 (e.g., the surface of an element located at the point of attachment with the panels 106 of the movable partition 102 (FIG. 1)).

The leading end assembly 110 may include a diagonal member 120 that is coupled to the leading end assembly 110 and the support trolley 116 (e.g., at an oblique angle to the leading end assembly 110, the support trolley 116, or both). For example, the diagonal member 120 may be coupled to a middle portion of the trailing surface 126 of the leading structure 122 (e.g., at a bracket 128 positioned between vertical ends of the leading structure 122)and to a portion of the support trolley 116. It is noted that as used herein, the term "vertical" references a vertical direction of the leading end assembly 110 as it is installed in a movable partition system 100 (i.e., vertically between a floor 101 and a ceiling 103 shown in FIG. 1). In such a configuration, the diagonal member 120, the support trolley 116, and a portion of the leading structure 122 may form a triangle to structurally support the leading end assembly 110.

Figure 2C:
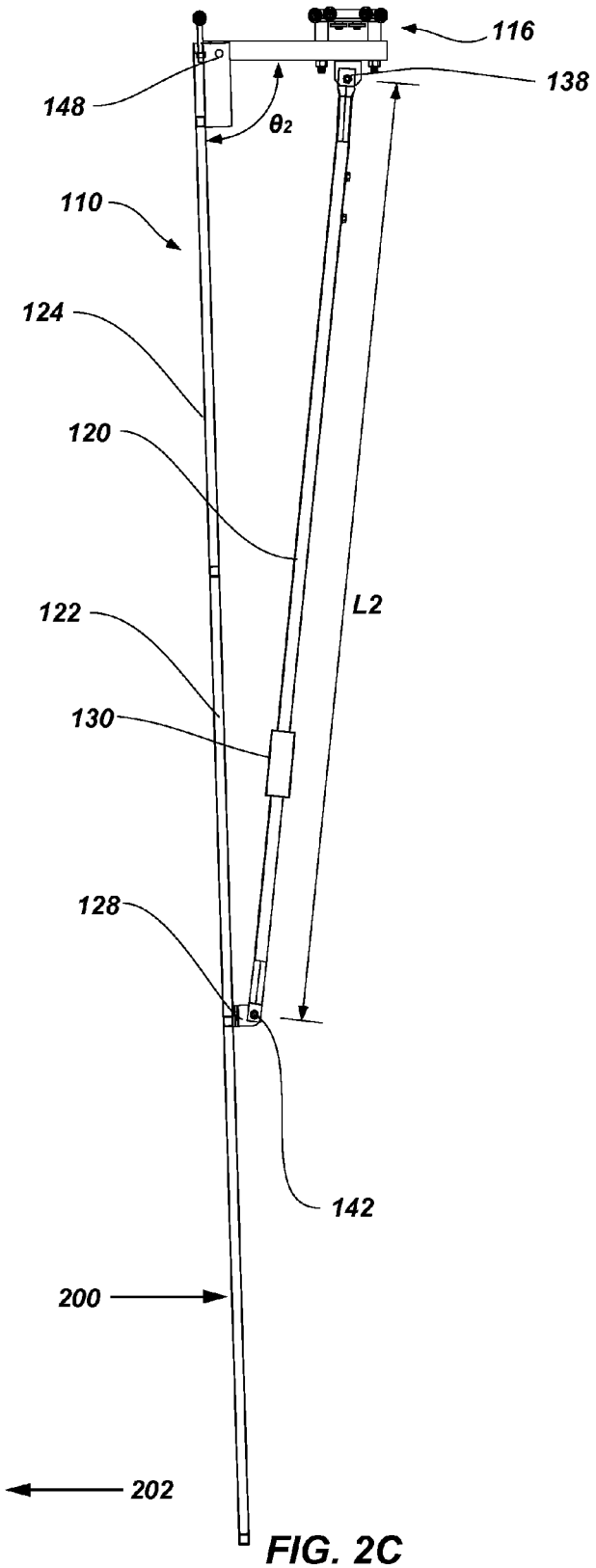

One or more portions of the leading end assembly 110 may be configured to enable movement (e.g., rotational movement, translational movement, combinations thereof) of a portion of the leading end assembly 110 relative to another portion of the leading end assembly 110. For example, one or more portions of the leading end assembly 110 (e.g., one or more couplings between the portions of the leading end assembly 110) may be configured to enable the leading structure 122 to move relative to a component attaching the leading end assembly 110 to an adjoining structure (e.g., the support trolley 116). For example, an attachment point such as, coupling pin 148, between the support trolley 116 and the leading structure 122 may enable the leading structure 122 to move relative to the support trolley 116. In some embodiments, the leading structure 122 may move from a first, initial position as shown in FIG. 2B to a second, displaced position as shown in FIG. 2C. The leading end assembly 110 may include a sensor (e.g., sensor 312 as discussed in greater detail below with reference to FIGS. 3 and 5) configured to sense movement of the leading end assembly 110 (e.g., movement of the leading structure 122 from the initial position to the displaced position).

Referring to FIG. 2B, the support trolley 116, the diagonal member 120, and the leading structure 122 may be coupled together such that the leading structure 122 may move relative to the support trolley 116. For example, couplings (e.g., couplings 138, 142) may each comprise an attachment point enabling motion between the coupled members (e.g., a coupling pin).

The diagonal member 120 may comprise at least one movable feature 130 that enables displacement of at least of a portion of the diagonal member 120, thereby, enabling the leading structure 122 to move relative to the support trolley 116. For example, the movable feature 130 may comprise at least one union such as, for example, a telescoping portion or movable coupling that enables translational movement, rotational movement, or combinations thereof.

As shown in FIG. 2B, the leading end assembly 110 may exhibit a first length L1 measured between coupling 138 and coupling 142 (e.g., the length of the diagonal member 120 measured between coupling 138 and coupling 142). In some embodiments, the first length L1 may be chosen to create a substantially 90 degree angle (e.g., angle $\theta_1$) between the leading surface 124 of the leading structure 122 and one or more of the support trolley 116, the track 112 (FIG. 1), and the floor 101 (FIG. 1). In other embodiments, the first length L1 may be chosen to create an angle of less than or greater than 90 degrees between the leading surface 124 and the track 112.

Referring now to FIG. 2C, a force 200 may be applied to the leading structure 122 in a direction substantially opposite a direction of intended travel 202 of the leading end assembly 110. For example, force 200 may result from an obstruction in the path of the movable partition 102 (shown in FIG. 1) as the support trolley 116 and the leading end assembly 110 move along the overhead track 112 (FIG. 1) from a retracted position to a extended position. Force 200 may cause movement of the leading structure 122 about coupling pin 148, thereby, imparting a compressive force to the diagonal member 120. The movable feature 130 of the diagonal member 120 enables a portion of the diagonal member 120 to displace (e.g., translate, rotate) under the force imparted to the diagonal member 120 by force 200 on the leading structure 122. For example, in embodiments where the movable feature 130 comprises a telescoping portion, a portion of the diagonal member 120 may displace into another portion of the diagonal member 120, as described in further detail below. Such displacement may reduce the length of the diagonal member 120 from the first length L1 shown in FIG. 2B to a second, lesser length L2 shown in FIG. 2C. The reduction of the length of the diagonal member 120 will enable the leading structure 122 to pivot about coupling pin 148. Diagonal member 120 may also pivot about coupling 138 and coupling 142 as the angle between the leading structure 122 and the support trolley 116 changes (e.g., decreases) due to rotation of the leading structure 122. For example, angle $\theta_2$ in FIG. 2C may be less than angle $\theta_1$ in FIG. 2B.

In other embodiments, the movable feature 130 may comprise a coupling enabling rotational displacement (e.g., a coupling or hinge enabling a first portion of the diagonal member 120 to rotate relative to a second portion of diagonal member 120). In such an embodiment, the distance between coupling 142 and coupling 138 may be reduced as the movable feature 130 of the diagonal member 120 translates in a direction substantially perpendicular to leading structure 122, thereby, reducing the distance between coupling 142 and coupling 138 (i.e., length L2).

In some embodiments, the movable feature 130 may enable the leading end assembly 110 to at least partially conform to an adjoining structure. For example, force 200 may result from contact of the leading surface 124 against an opposite wall 114B (shown in FIG. 1), or another contact surface such as a door jamb or a leading surface of another movable partition assembly. For example, if the opposite wall or other contact surface is not parallel to the leading surface 124, the telescoping portion of the diagonal member 120 enables rotation of the leading structure 122 about coupling pin 148 until the leading surface 124 is substantially parallel with (e.g., flush with, plumb with) the opposite wall or other contact surface.

In some embodiments, the leading structure 122 may be attached to the support trolley 116 with an elastic joint (e.g., comprising a metal, a metal alloy, a polymer material, or other materials having sufficient strength and elasticity) chosen to permit elastic deformation as the leading structure 122 displaces responsive to an applied force (e.g., force 200). The movable feature 130 of the diagonal member 120 may enable displacement of the leading structure 122 to a point at which the distance between coupling 138 and coupling 142 reaches a predetermined minimum length, such as length L2 shown in FIG. 2C. The minimum length may be selected to enable deformation of the elastic joint to a point before which plastic deformation occurs in the joint.

In some embodiments, one or more portions of the leading end assembly 110 may be configured to bias the leading structure 122 in the initial position (e.g., as shown in FIG. 2B) such that, when the leading structure 122 is displaced (e.g., by the force 200 applied to the leading structure 122 as shown in FIG. 2C), the leading structure 122 may be forced back to the initial position. For example, as discussed below in greater detail, a portion of the leading end assembly 110 (e.g., the movable feature 130 of the diagonal member 120) may comprise a biasing element (e.g., a spring).

Figure 3:
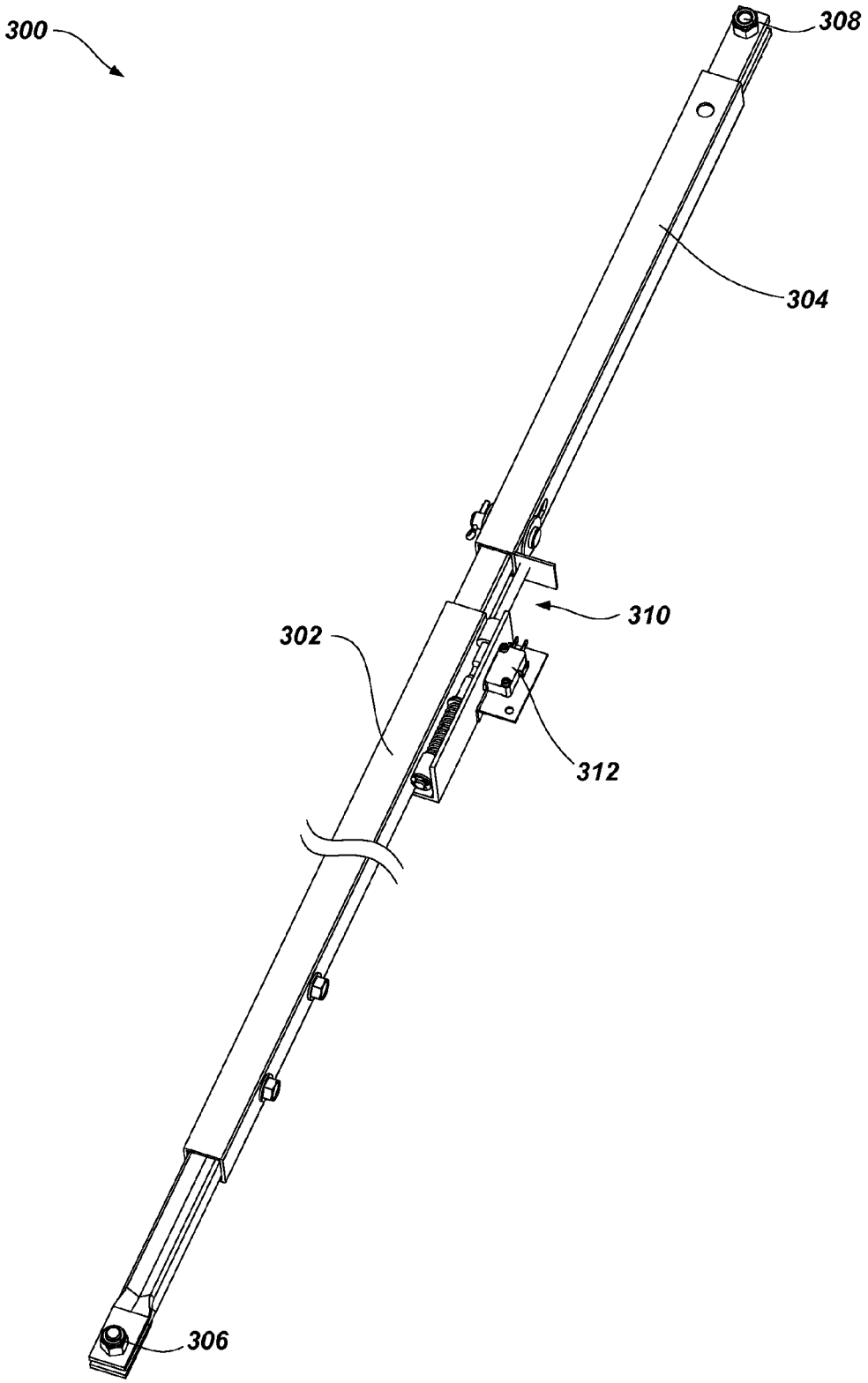
FIG. 3 is a perspective view of a diagonal member including a sensor for use with a movable partition such as that shown in FIG. 1 in accordance with an embodiment of the present disclosure.

Referring now to FIG. 3, a diagonal member 300 is shown in accordance with an embodiment of the present disclosure. Diagonal member 300 comprises a first member 302 and a second member 304. Each of the first member 302 and the second member 304 comprise ends with couplings 306 and 308, for example, for coupling with the leading structure 122 and support trolley 116, respectively. The diagonal member 300 includes a movable feature such as, for example, a telescoping portion 310. For example, the first and second members 302, 304 may connect at the telescoping portion 310 where a first portion of the diagonal member 300 (e.g., a portion of the first member 302) is received within another portion of the diagonal member 300 (e.g., the second member 304). As discussed below in greater detail, the portion of the first member 302 received in the second member 304 enables the length of diagonal member 300 to be decreased (e.g., from L1 to L2 as shown in FIGS. 2B and 2C) enabling the leading structure 122 of the leading end assembly 110 (FIG. 2C) to displace.

The diagonal member 300 may include a sensor 312 for sensing movement of the leading end assembly 110 (FIG. 2C). For example, sensor 312 may be positioned proximate to the diagonal member 300 (e.g., coupled to the first member 302) in order to be responsive to movement of the diagonal member 300. For example, the sensor 312 may be responsive to a telescoping action of the telescoping portion 310 when an applied force displaces the leading structure 122 of the leading end assembly 110 (FIG. 2C). In some embodiments, sensor 312 may communicate with the motor configured to drive the leading end assembly 110 along the overhead track 112 (FIG. 1). For example, sensor 312 may signal the motor to reduce speed, stop, reverse direction, or combinations thereof in response to a displacement of the telescoping portion 310.

Figure 4:
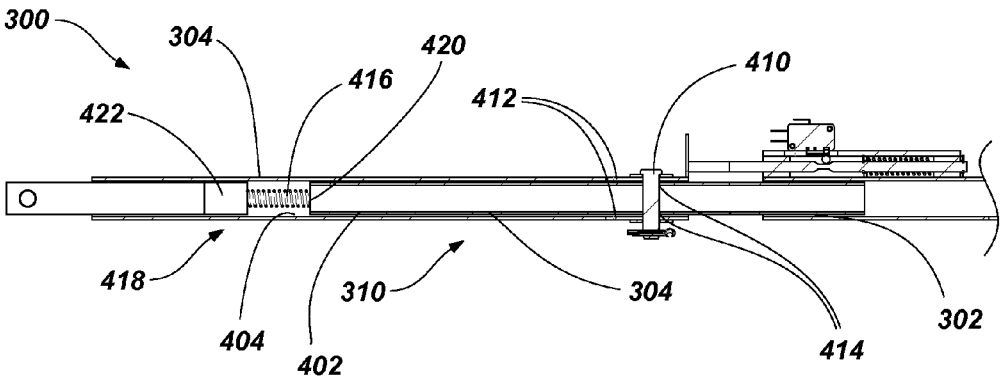
FIG. 4 is an enlarged, cross-sectional view of a portion of the diagonal member shown in FIG. 3.

FIG. 4 is a cross-sectional view of a telescoping portion 310 of the diagonal member 300. The telescoping portion 310 may be formed by the first member 302 comprising a protrusion 402 and the second member 304 comprising an aperture 404 that at least partially receives the protrusion 402 of the first member 302 therein. The first and second members 302, 304 that form the protrusion 402 and aperture 404 may comprise substantially complementary cross-sectional shapes (e.g., a square or other rectangle, a circle, regular or irregular polygons, etc.) as viewed on a plane normal to the length of the telescoping portion 310. The protrusion 402 of the first member 302 may comprise a cross-sectional dimension that is marginally smaller than a cross-sectional dimension of the aperture 404 of the second member 304, to enable the protrusion 402 of the first member 302 to slide freely within the aperture 404 of the second member 304. One or more of the portions of the first member 302 forming the protrusion 402 and the portion of the second member 304 forming the aperture 404 may comprise friction reducing material, such as bronze, brass, babbitt material, a polymer material, or any other suitable low-friction materials. In some embodiments, a bushing is disposed intermediate the portion of the first member 302 forming the protrusion 402 and the portion of the second member 304 forming the aperture 404. Other embodiments may include bearings, for example, needle bearings, disposed between the portion of the first member 302 forming the protrusion 402 and the portion of the second member 304 forming the aperture 404.

The first member 302 and the second member 304 may be coupled together in a manner to enable the portion of the first member 302 forming the protrusion 402 to move within the portion of the second member 304 forming the aperture 404. For example, one or more of the first member 302 and the second member 304 of the diagonal member 300 may have slots 412 formed therein (e.g., in opposing sides of the second member 304). A pin 410 may be disposed through the slots 412 in the second member 304 and through holes 414 in the first member 302. The pin 410 and the first member 302 may slide along the length of the slots 412 to enable movement of the first and second members 302, 304 relative to one another. Contact between ends of the slots 412 and pin 410 prevents extension or retraction beyond the translational movement allowed by the length of slots 412.

In some embodiments, the diagonal member 300 may include a biasing element 416 biasing the telescoping portion 310 to an extended position (e.g., a position where the telescoping portion 310 and diagonal member 300 are at a length, such as length L1 in FIG. 2B). For example, biasing element 416 may comprise a spring (e.g., a compression spring, an extension spring, or other suitable biasing elements). Biasing element 416 may abut an end portion 418 within the second member 304 forming a portion of the aperture 404, and may also abut an end portion 420 of the protrusion 402 of the first member 302. In some embodiments, the biasing element 416 may apply a force between the end portion 418 of the second member 304 and the end portion 420 of the first member 302 to maintain the telescoping portion 310 at a maximum length, such as length L1 in FIG. 2B.

The biasing element 416 may be chosen to determine the movement of the telescoping portion 310 and corresponding movement of the leading structure 122 (as in FIG. 2C) in response to an applied force (e.g., the amount of force applied to the leading structure 122 required to move the telescoping portion 310 a certain distance). For example, the biasing element 416 may comprise a length greater than the maximum distance between the second member end portion 418 and the first member end portion 420, thereby, placing the biasing element 416 in a preloaded condition when installed in the telescoping portion 310. In such a configuration, telescoping portion 310 requires application of a minimum force (equal in magnitude to the difference between the length of the biasing element 416 in an extended length and the maximum distance between end portions 418 and 420, multiplied by the spring constant of the biasing element 416) before displacement occurs. In other embodiments, the extended length of the biasing element 416 may be substantially the same as a maximum length between the first member end portion 420 and second member end portion 418, and the telescoping portion 310 will move in proportion to any applied force as determined by the spring constant of the biasing element 416. In some embodiments, the end portion 418 of the second member 304 may comprise an adjustment feature 422. For example, the adjustment feature 422 may include a threaded member enabling adjustment of the position of the end portion 418 of the second member 304. In such an embodiment, the maximum length between the first member end portion 420 and second member end portion 418 (i.e., the stiffness of the biasing element 416) may be adjusted by the adjustment feature 422.

It is noted that while the embodiment of FIG. 4 illustrates that the pin 410 remains stationary with respect to first member 302, and slides in slots 412 formed in second member 304, in other embodiments, pin 410 may remain stationary with respect to the second member 304 and slide in slots formed in the first member 302. In yet other embodiments, an extension coil spring may be connected between the pin 410 and the end portion 420 of the first member 302. As second member 304 is forced toward the first member 302 responsive to an applied force, a distance between the pin 410 and the end portion 420 of the first member 302 increases, extending the spring. The length and spring constant of the extension coil spring may be chosen as explained above. In yet other embodiments, the diagonal member 300 may include a damping mechanism such as, for example, an elastomeric or fluid damper, configured to dampen the movement of the telescoping portion 310 and prevent the joint from returning to an extended position too quickly after compression under an applied force.

Figure 5:
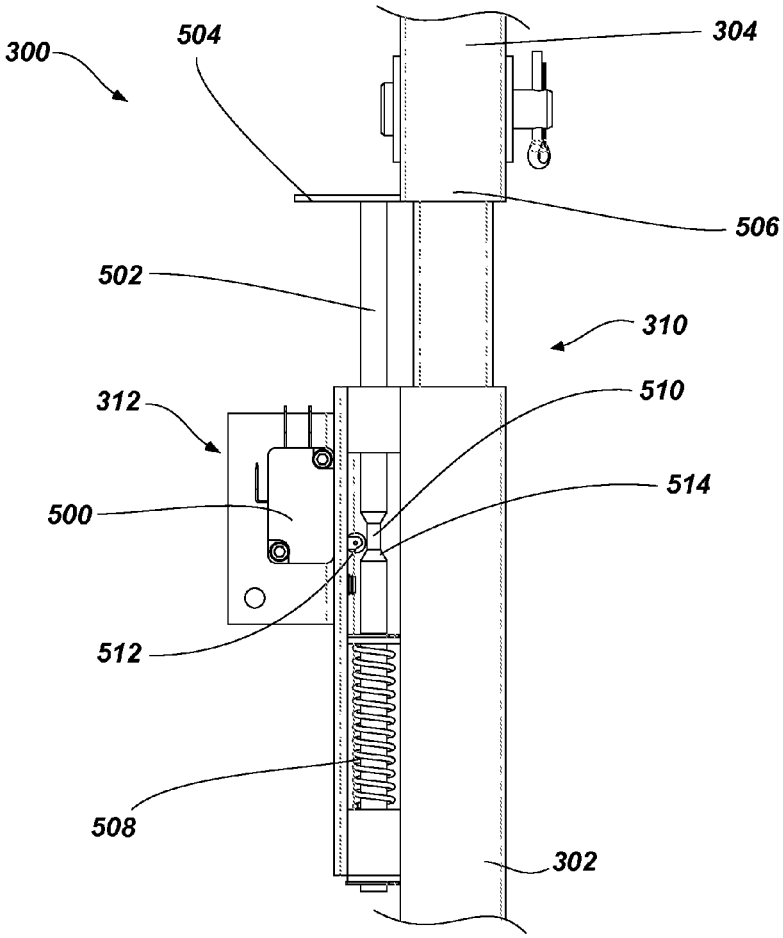
FIG. 5 is an enlarged view of another portion of the diagonal member shown in FIG. 3.

FIG. 5 is an enlarged perspective view of the telescoping portion 310 of the diagonal member 300 including a sensor 312. Sensor 312 may include an electrical switch 500 and an actuator rod 502 biased in an initial position by spring 508. A protruding tab 504 affixed to an end portion 506 of the second member 304 may contact the actuator rod 502. As second member 304 is forced toward first member 302 responsive to an applied force (e.g., a force applied to a leading structure 122 (FIG. 2C) connected to the second member 304), tab 504 presses on actuator rod 502 and causes actuator rod 502 to move and compress spring 508. As the actuator rod 502 is displaced, a portion of the actuator rod 502 may actuate the electrical switch 500. For example, an actuator 512 of the electrical switch 500 may be positioned proximate to a reduced diameter portion 510 of the actuator rod 502. As the actuator rod 502 is displaced, the diameter portion 510 of the actuator rod 502 translates relative to the actuator 512 of the electrical switch 500 and a shoulder area 514 of the actuator rod 502 may displace the actuator 512 in order to actuate the electrical switch 500. As actuator 512 displaces, switch 500 may signal an electric drive motor to slow, stop, or reverse movement of a leading end assembly of a movable partition.

In some embodiments, the movable partition system 100 may include control systems as described in, for example, U.S. patent application Ser. No. 13/165,165, filed Jun. 21, 2011, now U.S. Patent 8,544,524, issued Oct. 1, 2013, and entitled "Leading End Assemblies for Movable Partitions Including Sensor Assemblies, Movable Partition Systems Including Sensor Assemblies and Related Methods," which is assigned to the assignee hereof and the disclosure of which is incorporated herein in its entirety by this reference. In some embodiments, the leading end assembly 110 may include sensor assemblies such as those described in, for example, U.S. patent application Ser. No. 12/501,255, filed Jul. 10, 2009, now U.S. Patent 8,279,862, issued Oct. 2, 2012, and entitled "Motor Control Systems, Foldable Partitions Employing Motor Control Systems, Methods of Monitoring the Operation of Electric Motors and Foldable Partitions," which is assigned to the assignee hereof and the disclosure of which is incorporated herein in its entirety by this reference.

Figure 6:
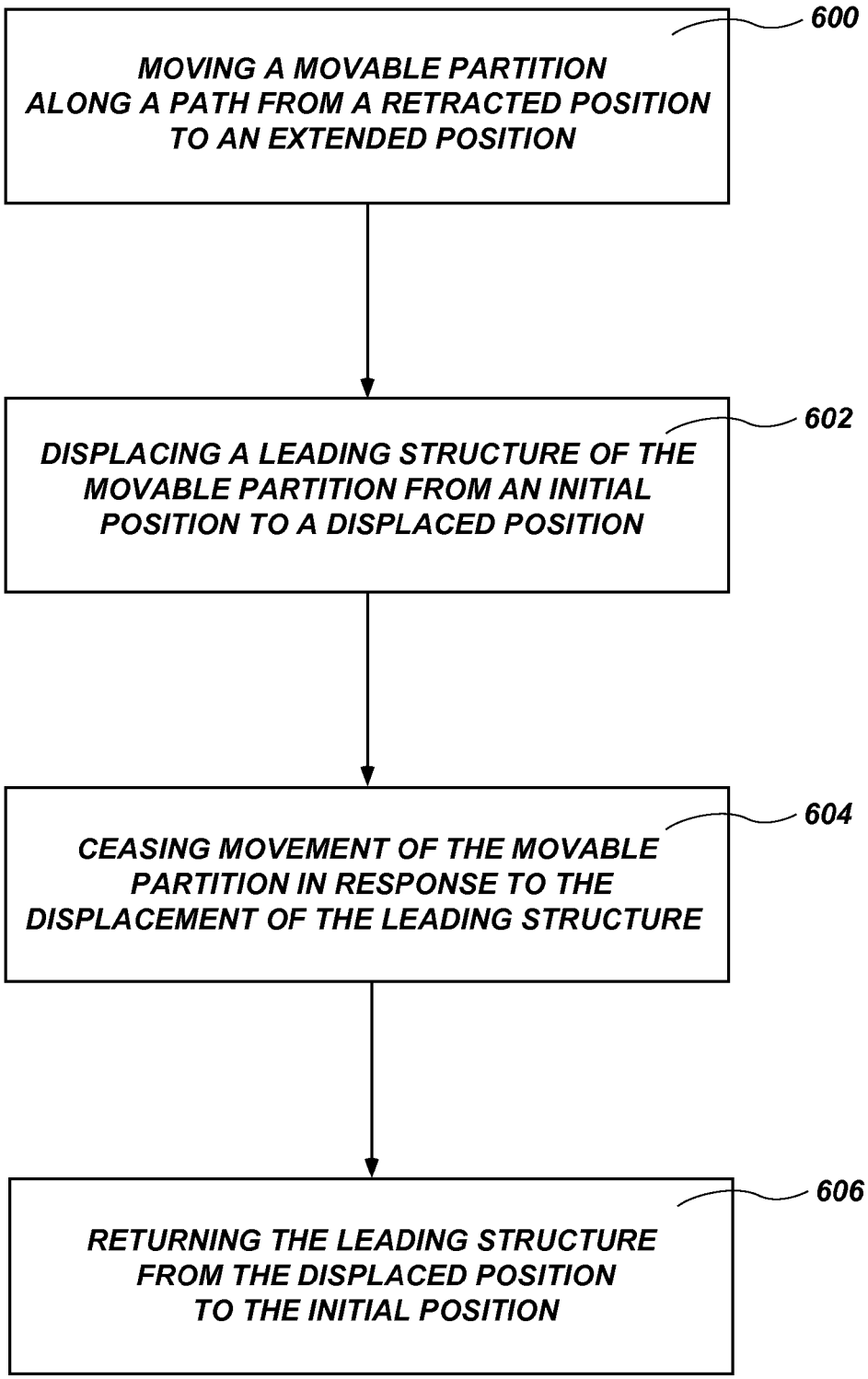
FIG. 6 is a flowchart illustrating an embodiment of a method of operating a movable partition such as that shown in FIG. 1.

FIG. 6 is a flowchart illustrating an embodiment of a method that may be used to operate a movable partition like that shown in FIG. 1. As shown in FIG. 6, in act 600, a method of operating a movable partition may include moving a leading end of a movable partition from a retracted position to an extended position.

In act 602, a leading structure of the movable partition may be displaced from an initial position to a displaced position responsive to a force applied to the leading structure, for example, an object or person in the path of the leading end while the leading end is moving. Displacement of the movable partition may comprise angular displacement about a connection at a distal end of a support trolley of the leading end assembly, for example the support trolley 116 disclosed in relation to FIG. 2A. A diagonal member such as, for example, the diagonal members 120, 300 discussed above may be disposed between the leading structure and the support trolley. The diagonal member may comprise a telescoping portion that enables angular displacement of the leading structure responsive to a force applied to the leading structure. The leading structure may displace from an initial position (e.g., a position where no external force is applied to the leading structure) to a displaced position (e.g., a position where an external force is applied and causes rotation about the connection near the support trolley and a corresponding reduction in length of the telescoping portion of the diagonal member). In some embodiments, movement of the telescoping portion may actuate a sensor, such as an electrical switch.

In act 604, a sensor disposed proximate the telescoping portion of the diagonal member may detect the movement of the telescoping portion and corresponding displacement of the leading structure. The sensor may then signal a drive motor to cease movement of the movable partition (e.g., movement of the movable partition may be halted, movement of the movable partition may be reversed, or combinations thereof).

In act 606, removal of the force applied to the leading structure allows the leading structure to rotate back from the second position to the initial position. As the leading structure rotates about the joint at the support trolley, the telescoping portion of the diagonal member may return to a previous extended length.

In view of the foregoing, leading end assemblies in accordance with embodiments of the present disclosure may provide a movable partition system having enhanced sensing of obstructions in a path of a movable partition and movable partition systems having improved security and fire or noise isolation between the spaces separated by the movable partition. In particular, such leading end assemblies including one or more components enabling movement of a portion of the leading end assembly may enable the detection of displacement of a portion of a leading end assembly caused by an obstruction along the path of the movable partition. Further, enabling movement (e.g., rotation) of a portion of the leading end assembly may enable the leading end assembly to at least partially conform (e.g., become substantially flush with) a contact surface when the movable partition is in an extended position.

While the present disclosure has been described herein with respect to certain embodiments, those of ordinary skill in the art will recognize and appreciate that it is not so limited. Rather, many additions, deletions and modifications to the described embodiments may be made without departing from the scope of the disclosure as hereinafter claimed, including legal equivalents. In addition, features from one embodiment may be combined with features of another embodiment while still being encompassed within the scope of the disclosure as contemplated by the inventors.

What is claimed is:

1. A movable partition system, comprising:

a plurality of hingedly coupled panels movably coupled to a track; and a leading end assembly comprising:

a trolley for moving the leading end assembly along the track;

a leading structure movably coupled to the trolley;

a diagonal member extending from the trolley at an oblique angle to the track, the diagonal member comprising at least one movable feature enabling, during operation of the movable partition system, the leading structure to displace from an initial position to a displaced position in response to a force applied to a leading surface of the leading structure by an object positioned along the track; and at least one sensor configured to sense movement of the leading structure between the initial position and the displaced position, wherein the at least one sensor is coupled to the movable feature.

2. The movable partition system of claim 1, wherein the leading structure is biased in the initial position.

3. The movable partition system of claim 1, wherein the at least one movable feature of the diagonal member comprises a telescoping portion.

4. The movable partition system of claim 3, wherein the telescoping portion of the diagonal member comprises:

a first member forming a protrusion; and a second member forming an aperture, wherein the protrusion of the first member is at least partially received and at least partially movable within the aperture formed by the second member.

5. The movable partition system of claim 4, wherein the telescoping portion of the diagonal member further comprises a biasing element biasing the telescoping portion in an extended position.

6. The movable partition system of claim 5, wherein the biasing element comprises a compression spring.

7. The movable partition system of claim 1, wherein, in the initial position, the leading surface of the leading structure is oriented at about a 90 degree angle to the support trolley, and wherein, in the displaced position, the leading surface is oriented at less than a 90 degree angle to the support trolley.

8. The movable partition system of claim 1, wherein, in the initial position, a distance between a coupling of the diagonal member and the support trolley and another coupling between the diagonal member and the leading structure exhibits a first length, and wherein, in the displaced position, the distance exhibits a second length that is less than the first length.

9. The movable partition system of claim 1, wherein, in the initial position, the diagonal member exhibits a first length, and wherein, in the displaced position, the diagonal member exhibits a second length that is less than the first length.

10. A movable partition system, comprising:

a plurality of hingedly coupled panels movably coupled to a track; and a leading end assembly comprising:

a trolley for moving the leading end assembly along the track;

a leading structure movably coupled to the trolley;

a diagonal member extending from the trolley at an oblique angle to the track, the diagonal member comprising a telescoping portion enabling the leading structure to displace from an initial position to a displaced position; and at least one sensor configured to sense movement of the leading structure between the initial position and the displaced position, wherein the sensor is coupled to the diagonal member on the telescoping portion and comprises an electronic switch configured to directly sense telescoping movement of the telescoping portion.

11. A movable partition system, comprising:

a movable partition comprising:

a plurality of hingedly coupled panels movably coupled to a track; and a leading end assembly coupled to at least one panel of the plurality of hingedly coupled panels, the leading end assembly comprising:

a trolley movably coupled to the track;

a leading structure suspended from and coupled to the trolley; and a diagonal member coupled to the leading structure and the trolley, the diagonal member comprising at least one movable union to enable rotation of the leading structure relative to the trolley during operation of the movable partition system; and a sensor configured to sense rotation of the leading structure relative to the trolley, wherein the sensor is coupled to the movable union.

12. The movable partition system of claim 11, wherein the diagonal member comprises a biasing element biasing the leading structure in an initial position.

13. The movable partition system of claim 11, wherein the at least one movable union of the diagonal member comprises a telescoping portion.

* * * * *

UNITED STATES PATENT AND TRADEMARK OFFICE

CERTIFICATE OF CORRECTION

PATENT NO. : 8,899,299 B2
APPLICATION NO. : 13/234439
DATED : December 2, 2014
INVENTOR(S) : Ivan W. Stewart It is certified that error appears in the above-identified patent and that said Letters Patent is hereby corrected as shown below:

In the specification:

| | | | |
|---|---|---|---|
| | COLUMN 7, | LINE 21, | change “length of diagonal” to --length of the diagonal-- |

In the claims:

| | | | |
|---|---|---|---|
| CLAIM 10, | COLUMN 12, | LINE 12, | change “the sensor” to --the at least one sensor-- |

Signed and Sealed this
Thirteenth Day of October, 2015

Michelle K. Lee

Michelle K. Lee
*Director of the United States Patent and Trademark Office*